US008417166B2

(12) United States Patent
Nakamura

(10) Patent No.: US 8,417,166 B2
(45) Date of Patent: Apr. 9, 2013

(54) IMAGE FORMING APPARATUS WITH A DEVIATION ABSORBING TRANSFER APPARATUS

(75) Inventor: Masakazu Nakamura, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 12/810,826

(22) PCT Filed: Jun. 25, 2009

(86) PCT No.: PCT/JP2009/061589

§ 371 (c)(1),
(2), (4) Date: Jun. 25, 2010

(87) PCT Pub. No.: WO2010/004876

PCT Pub. Date: Jan. 4, 2010

(65) Prior Publication Data

US 2010/0278568 A1 Nov. 4, 2010

(30) Foreign Application Priority Data

Jul. 11, 2008 (JP) ..... 2008-181192

(51) Int. Cl.
*G03G 15/20* (2006.01)

(52) U.S. Cl.
USPC ..... 399/313

(58) Field of Classification Search ..... 399/299, 399/302, 303, 313, 316, 317
See application file for complete search history.

(56) References Cited

U.S. PATENT DOCUMENTS

| | | | | | |
|---|---|---|---|---|---|
| 5,440,379 | A * | 8/1995 | Hayamizu | 399/308 |
| 5,574,550 | A * | 11/1996 | Okazaki et al. | 399/313 |
| 5,630,194 | A * | 5/1997 | Fujita et al. | 399/38 |
| 5,666,622 | A * | 9/1997 | Harasawa et al. | 399/313 |
| 5,669,054 | A * | 9/1997 | Uchida et al. | 399/313 |
| 5,983,062 | A | 11/1999 | Sameshima | |
| 2006/0045548 | A1 * | 3/2006 | Takiguchi | 399/21 |

FOREIGN PATENT DOCUMENTS

| | | |
|---|---|---|
| JP | 4-345183 | 12/1992 |
| JP | 6-348148 | 12/1994 |
| JP | 2002-148967 | 5/2002 |

OTHER PUBLICATIONS

English-language International Search Report from the Japanese Patent Office mailed Jul. 21, 2009, for International Application No. PCT/JP2009/061589.

Chinese Office Action, Application No. 200980101506.9, mailing No. 2011122800372970, mailed Dec. 31, 2011, pp. 1-4.

(Continued)

*Primary Examiner* — Sandra Brase

(74) *Attorney, Agent, or Firm* — Finnegan, Henderson, Farabow, Garrett & Dunner, L.L.P.

(57) ABSTRACT

An image forming apparatus includes a transfer unit having an endless transfer belt stretched over a plurality of rollers, a pair of integrated support side plates for supporting the plurality of rollers rotatably, a pair of press side plates supported, to be able to rotate in the direction of moving toward or away from the image carrier, by means of a supporting member provided in the frame of the transfer unit, a swing portion provided on the press side plates and supporting the support side plates swingably with respect to the image carriers when the transfer belt and the image carriers are pressed, and a member for urging the press side plates in the direction that the transfer belt presses the image carrier.

6 Claims, 7 Drawing Sheets

OTHER PUBLICATIONS

Notice of Reasons for Refusal dated Feb. 28, 2012, issued in Japanese Application No. 2010-519727, with English language translation (6 pages).

Decision of Refusal dated Dec. 25, 2012, issued in corresponding Japanese Application No. 2010-519727 (2 pages), with English language translation (2 pages).

* cited by examiner

IMAGE FORMING APPARATUS WITH A DEVIATION ABSORBING TRANSFER APPARATUS

CROSS REFERENCE TO RELATED APPLICATIONS

This application is a national phase application based on International Application No. PCT/JP2009/061589, filed Jun. 25, 2009, which claims the priority of Japanese Patent Application No. 2008-181192, filed Jul. 11, 2008, the content of both of which is incorporated herein by reference.

TECHNICAL FIELD

The present invention relates to an image forming apparatus such as a printer, a copy machine, and a facsimile, and to an image forming apparatus, which transfers a toner image formed on an image carrier onto a recording paper sheet by a physical action via a transfer apparatus having a rotating transfer belt, after which the recording paper sheet, on which a toner image has been attached, is conveyed to a fixing apparatus, and then, the image is fixed.

BACKGROUND TECHNOLOGY

An image forming apparatus using an electrophotographic system has an image forming process that a latent image carried on a photoreceptor is developed to a toner image by a developing apparatus, and, subsequently, the above toner image is transferred to a recording paper sheet, and then, the resulting transferred image is fixed on the recording paper sheet. In the above transfer, there are two transfers; one is that a toner image is directly transferred from a photoreceptor drum, which is an image carrier, onto a recording paper sheet; and another one is that a toner image formed on a photoreceptor drum is primary transferred onto the surface of an intermediate transfer body, which is an image carrier, and, subsequently, the above toner image is secondary transferred onto a recording paper sheet. Many of the above intermediate transfer bodies are provided, as an image carrier, with an intermediate transfer belt, which is wound about by a plurality of rollers.

As the transfer apparatus, which transfers a toner image on the above image carrier onto a recording paper sheet, there has been known the above photoreceptor drum, or a transfer apparatus, which is provided with a transfer belt opposing to rollers stretching and supporting an intermediate transfer belt, and press rollers pressing the above transfer belt.

The above transfer apparatus transfers an image formed on the surface of the above transfer belt by nipping a recording paper sheet between an image carrier and a transfer belt, pressing the above transfer belt to the above image carrier by press rollers, and allowing the recording paper sheet to pass through while applying a transfer bias.

Since the above transfer belt has a manner that a recording paper sheet is pressure contacted against the outer peripheral surface of an image carrier to transfer a toner image while conveying the recording paper sheet at a constant speed, it is required that the above pressure contact state means a uniform pressure distribution across a width direction of the image carrier. However, since the above transfer belt is, as is commonly known, a wide belt, it is difficult to make a uniform pressure contact against the image carrier, and accordingly, due to a pressure difference, unevenness of image density was likely to occur.

Coping with the above problem, a transfer conveyance unit has been disclosed (refer, for example, to Patent Document 1), in which the unit is provided with a transfer belt, which transfers a toner image on a photoreceptor drum (an image carrier) onto a recording paper sheet and conveys the recording paper sheet, and it is arranged so that, centering around drive shafts stretching and arranging the above transfer belt, both the right and left end portions of driven shafts side are raised by two compression springs, and at the same time, at least one of the shaft supporting parts of the drive shafts is made swingable centering around another shaft supporting part.

PRIOR ARTS

Patent Document

Patent Document 1: Japanese Patent Application No. H4-345183

SUMMARY OF THE INVENTION

Issues to be Solved by the Invention

The invention in Patent Document 1 is arranged so that, centering around drive shafts, which arrange in a tensioned state the above transfer belt, both the right and left end portions of driven shafts side are raised by two compression springs, and at the same time, at least one of the shaft supporting parts of the drive shafts is made swingable centering around another shaft supporting part, whereby it is arranged so that an inclination of an image carrier can be followed. However, it was possible to absorb deviation (an inclination) in a vertical direction between an image carrier and press rollers, but it was difficult to absorb deviation (an inclination) in a horizontal direction therebetween.

The present invention has been achieved in consideration of the above situations, and it is an object of this invention to provide an image forming apparatus provided with a transfer apparatus, which image forming apparatus can prevent a transfer failure, whereby a high quality image can be obtained, even if a relative position between press rollers and a photoreceptor drum, which is an image carrier opposing to the press rollers, or between press rollers and rollers stretching and supporting an intermediate transfer belt, which belt is also an image carrier, is shifted from the parallel to either vertical or horizontal direction.

Measures to Solve the Issues

The above object can be achieved by constitutions described below.

Item 1. An image forming apparatus comprising an image carrier carrying a toner image, and a transfer apparatus transferring the toner image formed on the above image carrier onto a recording paper sheet, wherein the above transfer apparatus is comprised of an endless transfer belt; a plurality of rollers, which are rollers stretching and supporting the above transfer belt, containing press rollers pressing the above transfer belt to the above image carrier; a pair of integrated support side boards, which rotatably support the above plurality of rollers; a pair of press side boards, which are rotatably supported in an attachable/detachable direction with respect to the above image carrier by a support member arranged in a frame body of the above transfer apparatus; a swing section, which is arranged in the above press side boards, and swingably supports the above support side boards with respect the above image carrier, during pressing the above transfer belt and the above image carrier; and an urging member, which urges the above press side boards in a direction in which the above transfer belt presses the above image carrier.

Item 2. The image forming apparatus described in Item 1, wherein the above swing section is provided with the second support member, which rotatably supports the above support side boards arranged on the above press side boards, and the second urging member, urges the above support side boards in a direction that the above transfer belt presses the above image carrier.

Item 3. The image forming apparatus described in Item 1, wherein the above swing section is provided with an elastic deformation member at an approximate center part between a connection portion between the above press side boards and the above support member and a connection portion between the above press side boards and the above support side boards.

Item 4. The image forming apparatus described in Item 1, wherein the above swing section is provided with the elastic deformation member at a connection portion between the above press side boards and the above support side boards.

Item 5. The image forming apparatus described in Item 1, wherein the above swing section is provided with an elastic deformable structure portion on a part of the above press side boards between a connection portion between the above press side boards and the above support member and a connection portion between the above press side boards and the above support side boards.

Effects of the Invention

With the above constitutions, even if the relative position between the press rollers and the photoreceptor drum opposing to the press rollers, or between the press rollers and the rollers stretching and hanging the intermediate transfer belt is shifted from the parallel to either vertical or horizontal direction, the above transfer belt can be pressed so that the above transfer belt follows the above photoreceptor drum or intermediate transfer belt, whereby a uniform pressure strength can be achieved. With this, it is possible to reduce a transfer failure, thereby obtaining a high quality image. Further, since a twist of the above transfer belt can be prevented, a deviation can also be prevented, to improve a running stability of the above transfer belt.

BEST MODES FOR CARRYING OUT THE INVENTION

The embodiments of the image forming apparatus relating to the present invention will be described with reference to drawings. But the present invention is not limited to the embodiments described below.

Figure 1:
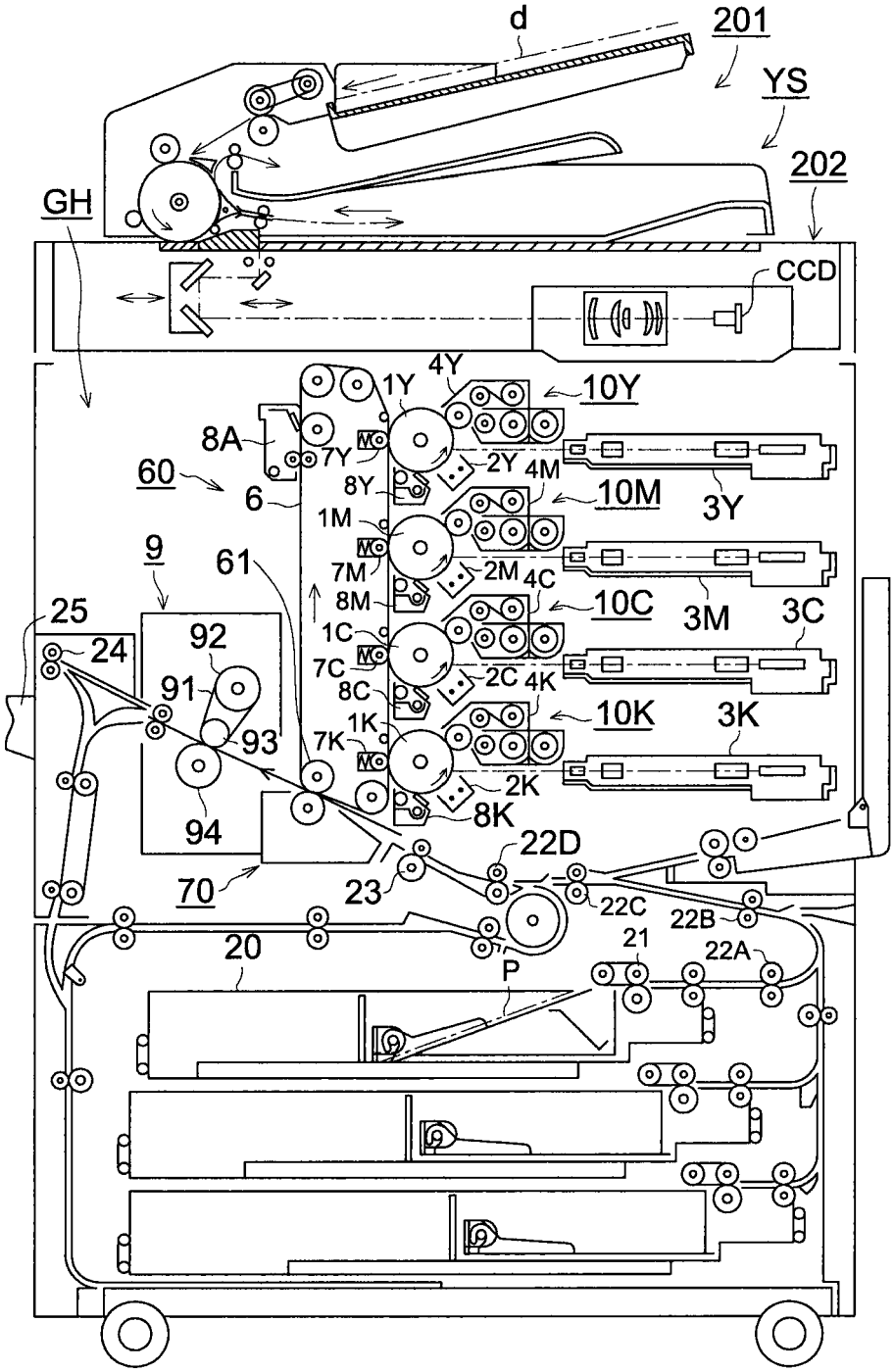
FIG. 1 is a schematic view showing an example of the image forming apparatus relating to the present invention.

FIG. 1 is a schematic view showing an example of the image forming apparatus provided with the transfer apparatus relating to the present invention.

The image forming apparatus relating to the present invention is constituted of a main body of an image forming apparatus GH, and an image reading apparatus YS. The main body of the image forming apparatus GH is called a tandem type color image forming apparatus, and is constituted of a plurality of pairs of image forming units 10Y, 10M, 10C, and 10K, an intermediate transfer unit 60 having an intermediate transfer belt 6, which is an endless belt-like intermediate transfer body, a transfer apparatus 70, a paper feed conveyance member, a fixing apparatus 9, and the like.

In the upper part of the image forming section GH, there is arranged the image reading apparatus YS composed of an automatic document feeding apparatus 201, and a scanning exposure apparatus 202. A document d, placed on a document table of the automatic document feeding apparatus 201, is conveyed by a conveyance member, and an image on one side or images on both sides of the document are scanning exposed by an optical system of the document image scanning exposure apparatus 202 to be read in a line-image sensor CCD.

A signal, formed by a photoelectrical conversion by the line-image sensor CCD, is subjected, at an image processing section, to an analogue processing, an A/D conversion, a shading compensation, an image compression processing, and the like, after which the image signal is sent to exposure units 3Y, 3M, 3C, and 3K.

The image forming unit 10Y, which forms a yellow (Y) image, has a charging apparatus 2Y, an exposure apparatus 3Y, a developing apparatus 4Y, and a cleaning member 8Y around a photoreceptor drum 1Y. The image forming unit 10M, which forms a magenta (M) image, has a charging apparatus 2M, an exposure apparatus 3M, a developing apparatus 4M, and a cleaning member 8M around a photoreceptor drum 1M. The image forming unit 10C, which forms a cyan (C) image, has a charging apparatus 2C, an exposure apparatus 3C, a developing apparatus 4C, and a cleaning member 8C around a photoreceptor drum 1C. And the image forming unit 10K, which forms a black (Bk) image, has a charging apparatus 2K, an exposure apparatus 3K, a developing apparatus 4K, and a cleaning member 8K around a photoreceptor drum 1K. And, each of the pairs of the charging apparatus 2Y and the exposure apparatus 3Y, the charging apparatus 2M and the exposure apparatus 3M, the charging apparatus 2C and the exposure apparatus 3C, and the charging apparatus 2K and the exposure apparatus 3K constitutes a latent image forming section.

The intermediate transfer body 6 is wound about and rotatably supported by a plurality of rollers.

A fixing apparatus 9 is provided with a first press roller 93 having a elastic body layer on its core; a heat roller 92 having a heating member inside thereof; an endless fixing belt 91, which is stretched and hung across between the first press roller 93 and the heat roller 92; and a second press roller 94, which is arranged so as to be capable of pressure contact to the fixing belt 91 at a position opposing to the first press roller 93, and forms a fixing nip portion and heats and presses unfixed toner on a recording paper sheet P to fix the toner image, by passing the recording paper sheet P, which carries an unfixed image, through the fixing nip portion, with a surface, on which unfixed toner exists, being contacted to the fixing belt 91.

In this way, the image of each color formed by the image forming units 10Y, 10M, 10C, and 10K is successively transferred with being superimposed (the primary transfer) by transfer members 7Y, 7M, 7C, and 7K on the rotating intermediate transfer body 6, whereby an image, in which color images were combined into one, is formed. The recording paper sheet P, stored in a paper feed cassette 20, is fed by a paper feed member 21, and conveyed to the transfer apparatus 70, through paper feed rollers 22A, 22B, 22C, and 22D, registration rollers 23, and the like, and then, a color image is transferred on the recording paper sheet P (the secondary transfer). The recording paper sheet P, onto which the color image has been transferred, is heated and pressed at the fixing apparatus 9, whereby the color image on the recording paper sheet P is fixed. After that, the recording paper sheet P is nipped by sheet discharge rollers 24, and then, placed on a sheet discharge tray 25, which is attached to the outside of the image forming apparatus.

The residual toner remaining on the intermediate transfer body 6, from which the recording paper sheet P has been separated due to different radii of curvature after the color image has been transferred onto the recording paper sheet P by the transfer apparatus 70, is removed by a cleaning member 8A.

Next, the transfer apparatus 70 will be described.

Figure 2:
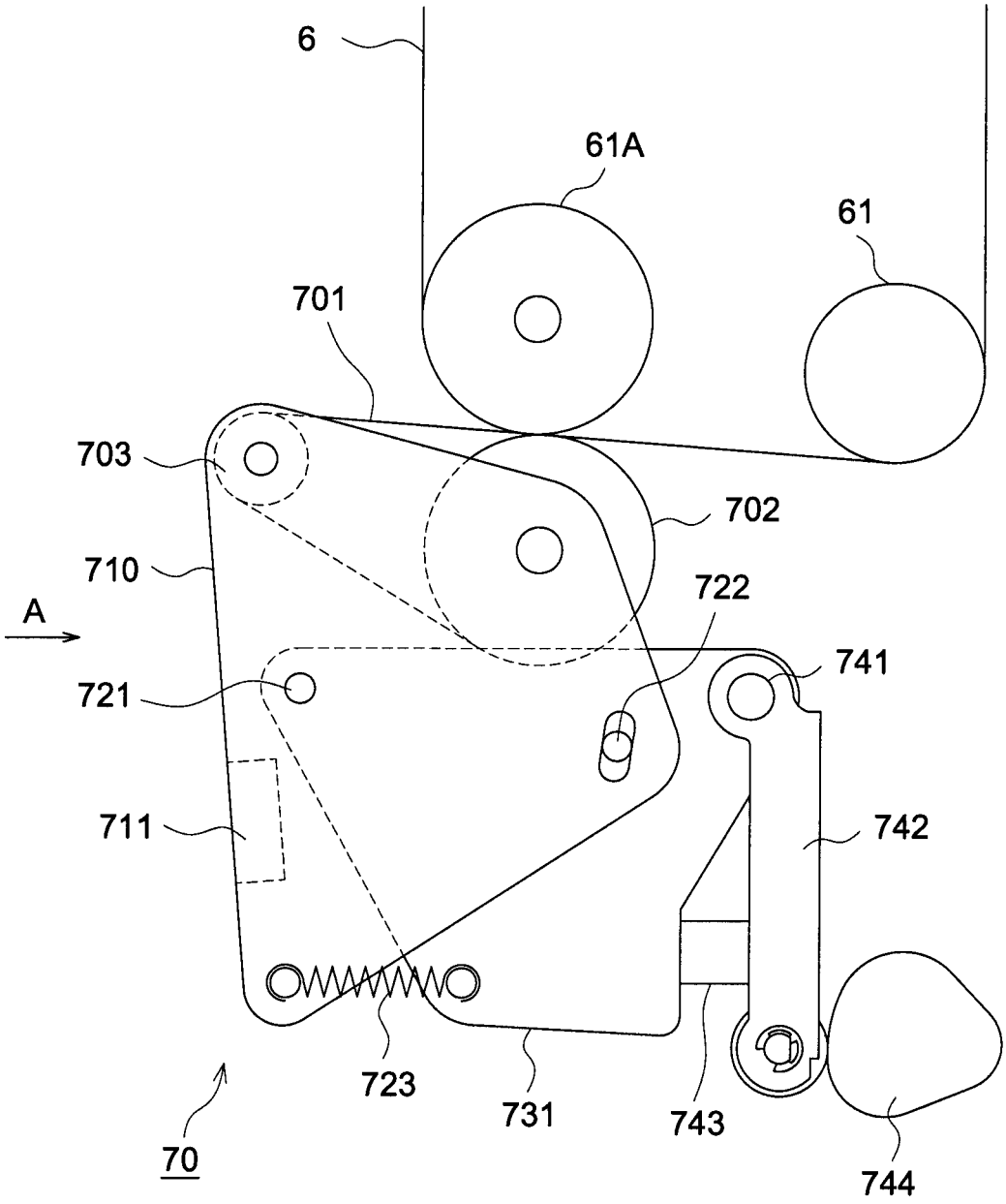
FIG. 2 is a partial diagrammatic view of the transfer apparatus relating to the present invention.

FIG. 2 is a partial diagrammatic view of the transfer apparatus 70. The intermediate transfer belt 6 is stretched and hung across between a plurality of rollers. Among rollers 61, a roller, which nips the intermediate transfer belt 6 and is facing to a press roller 702, is called a backup roller 61A.

The transfer apparatus 70 comprises an endless transfer belt 701, which is stretched and hung across between a plurality of rollers. In the example shown in FIG. 2, as the plurality of rollers, the press roller 702 and a tension roller 703 are used. The press roller 702 and the tension roller 703 are rotatably supported by a pair of support side boards 710 arranged on the front and back sides of the figure. The pair of support side boards 710 are integrally connected by a connection member 711.

A pair of press side boards 731, arranged on the front and back sides of the figure, are rotatably supported in an attachable/detachable direction with respect to the intermediate transfer belt 6 by a support member 741 arranged in a frame body (not illustrated) of the transfer apparatus 70.

The support side boards 710 are swingably supported with respect to the intermediate transfer belt 6 by the swing section arranged on the press side boards 731, when the transfer belt 701 is pressed to the intermediate transfer belt 6. This means that the support side boards 710, the transfer belt 701, and the press roller 702 are swingably supported in an integrated manner, against the intermediate transfer belt 6 and backup roller 61A.

The above swing section is constituted containing; a support member 721, which is a second support member supporting the support side boards 710 arranged on the press side boards 731; and tension springs 723, which are second urging members to urge the support side boards 710 in the pressing direction that the press roller 702 presses the backup roller 61A. The tension springs 723 are arranged so as to work between the support side boards 710 and the press side boards 731. As a receiving member of the support side boards 710 engaging with the support member 721, a swingable member with respect to the support member 721, for example a self-aligning bearing (not illustrated), is preferably used.

The press side boards 731 are provided with regulation members 722, which engage with slotted holes of the support side boards 710, and restrict a swing extent of the support side boards.

The pair of press side boards 731 are urged by compression springs 743, which are urging members arranged between a pair of urging arms 742, in a direction that the press roller 702 presses the backup roller 61A. The urging arm 742 is rotatably supported by the support member 741, and swung by a cam 744. With this mechanism, urging and release of urging are conducted. The press of the press roller 702 against the backup roller 61 is conducted with compression spring 743 and the tension spring 723, by swinging the urging arm by the cam 744 in the left direction of FIG. 2 (the position shown in FIG. 2).

Figure 3:
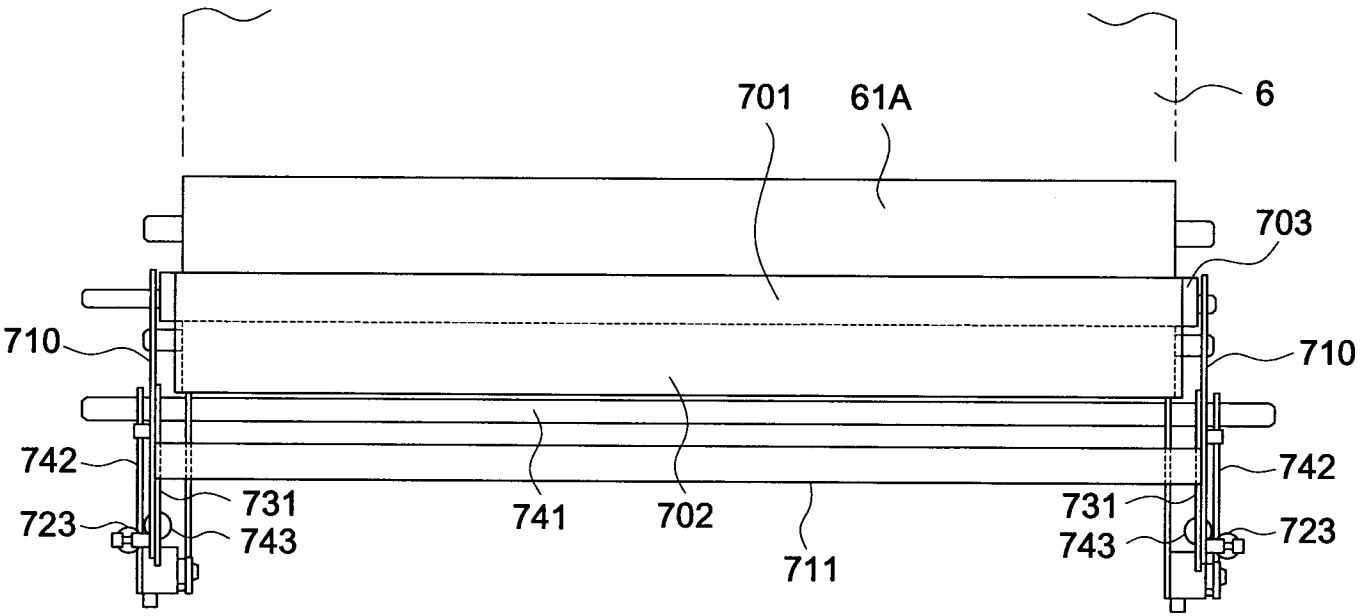
FIG. 3 is a side view of the transfer apparatus relating to the present invention.
Figure 4:
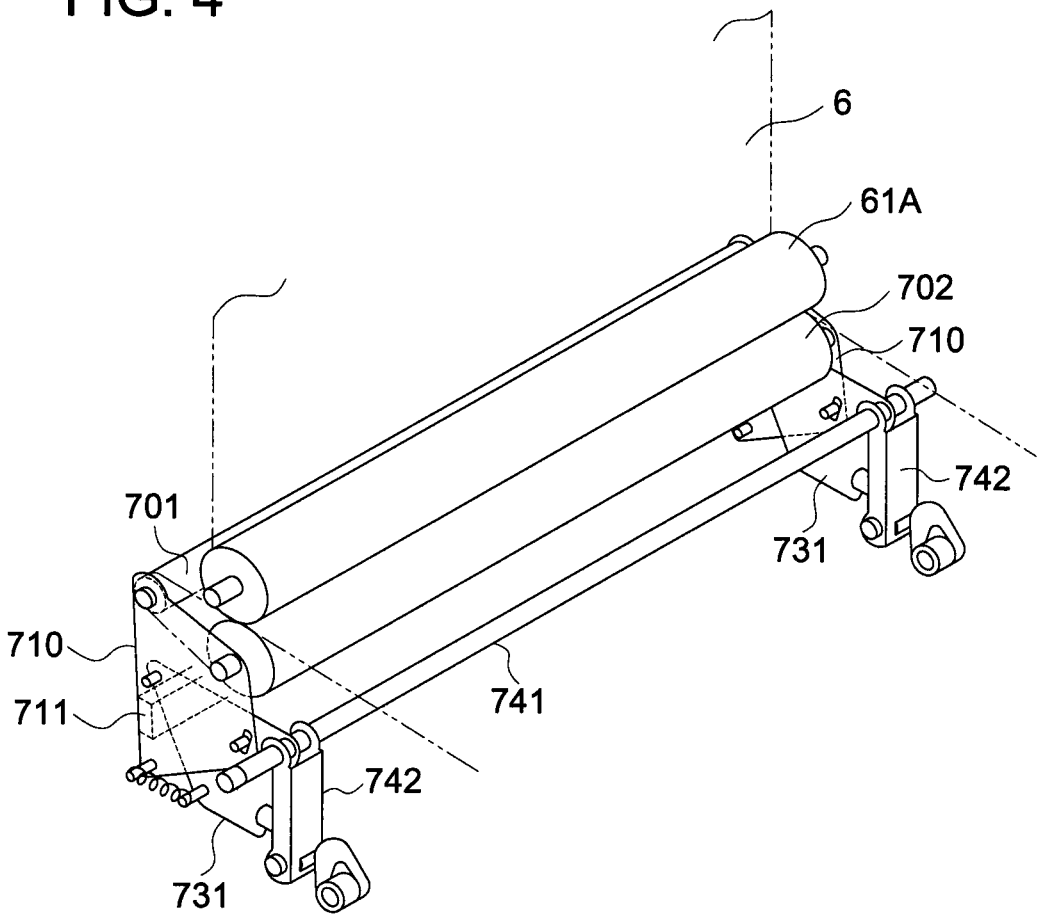
FIG. 4 is an oblique perspective figure of the transfer apparatus relating to the present invention.

FIG. 3 is a side view of the transfer apparatus 70 when viewed from the arrow A direction in FIG. 2, and FIG. 4 is an oblique perspective figure thereof.

FIG. 2 shows a case where an axis of the backup roller 61A and an axis of the press roller 702 are parallel with each other. In this case, when the press roller is pressed against the backup roller 61A, the press is uniformly conducted, the press between the transfer belt 701 and the intermediate transfer belt 6 becomes uniform, resulting in neither transfer failure nor deviation of the belts.

However, there may be happened that the axis of the backup roller 61A deviates from parallel with respect to the axis of the press roller 702.

Figure 5:
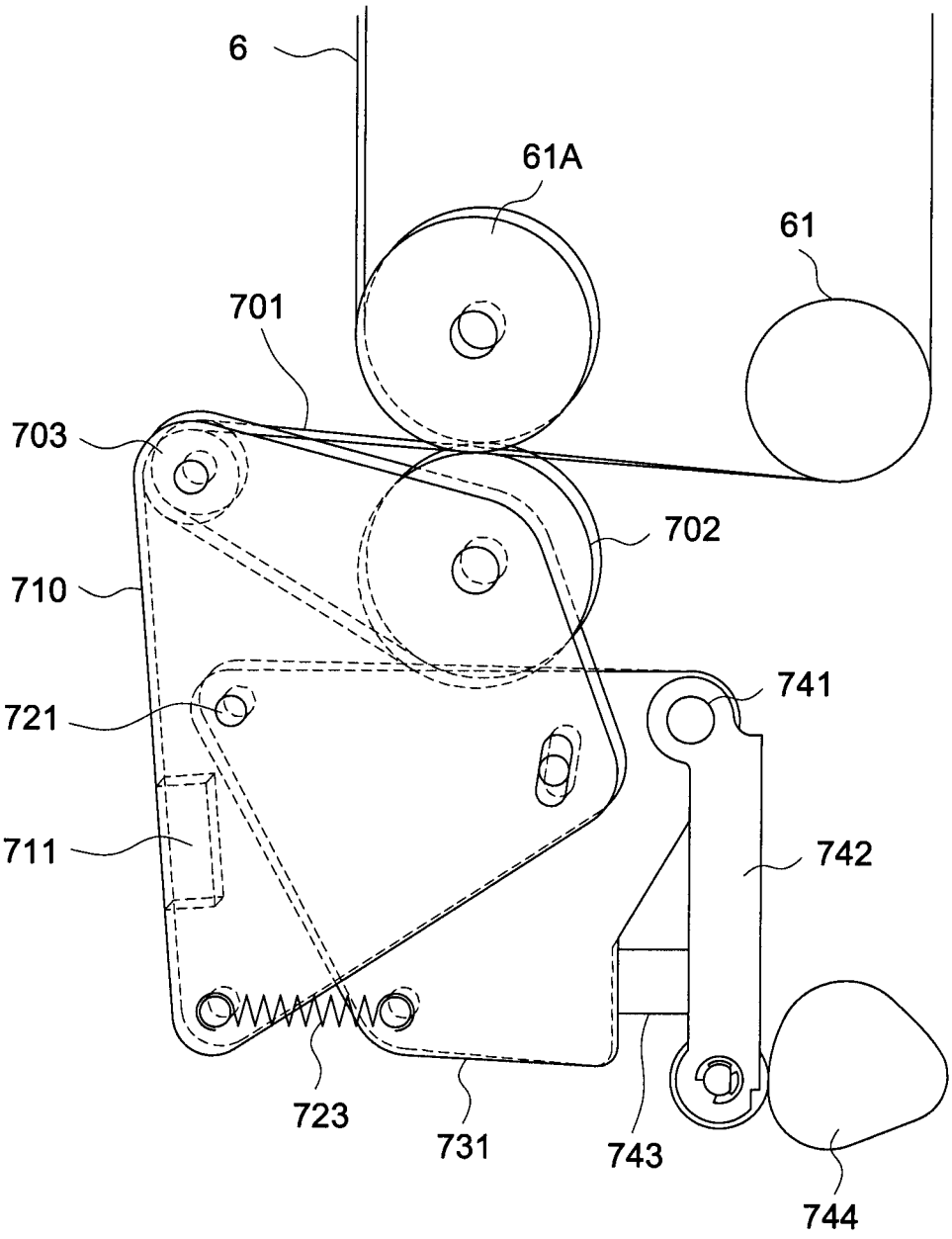
FIG. 5 is a figure showing a state that the back of an axis of a backup roller is shifted with respect to an axis of a press roller.

FIG. 5 shows a case where the back side of the axis of the backup roller 61A deviates with respect to the axis of the press roller 702 in the upper and right direction of the figure.

In such a case, by the conventional methods as described above (for example, Patent Document 1), it was possible to absorb deviation (an inclination) in a vertical direction between the backup roller 61A and the press roller 702, but it was difficult to absorb deviation of a horizontal direction and compounded deviation (an inclination) in a horizontal and vertical directions therebetween.

Coping with the above problem, since, in the present invention, the support side boards 710 are swingably supported with respect to the intermediate transfer belt 6 (the backup roller 61A) by the swing section provided with the press side boards 731, the press roller 702 and transfer belt 701 also become swingable.

Due to the above reason, as shown in FIG. 5, the transfer belt 701 can be pressed to the intermediate transfer belt 6 so as to follow the deviation of the backup roller 61A, whereby a uniform pressure strength can be achieved. With this, it is possible to reduce a transfer failure, thereby obtaining a high quality image. Further, since a twist of the support board 710 is not caused, a deviation of the transfer belt 701 can also be prevented, to improve a running stability of the transfer belt 701.

Figure 6:
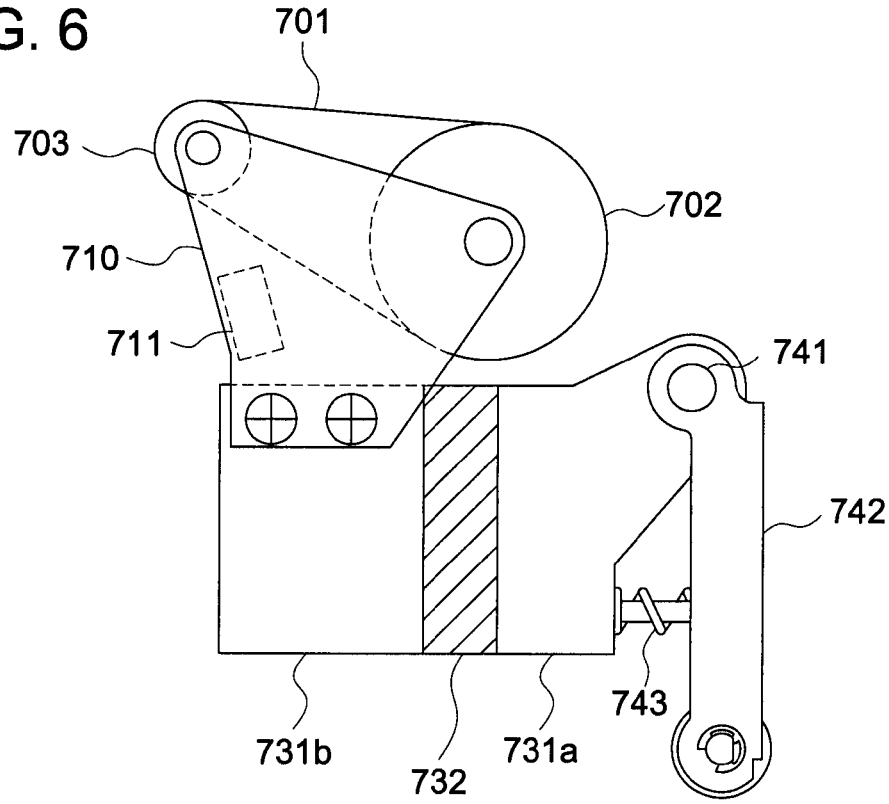
FIG. 6 is a figure showing a modified example of a swing section.
Figure 7:
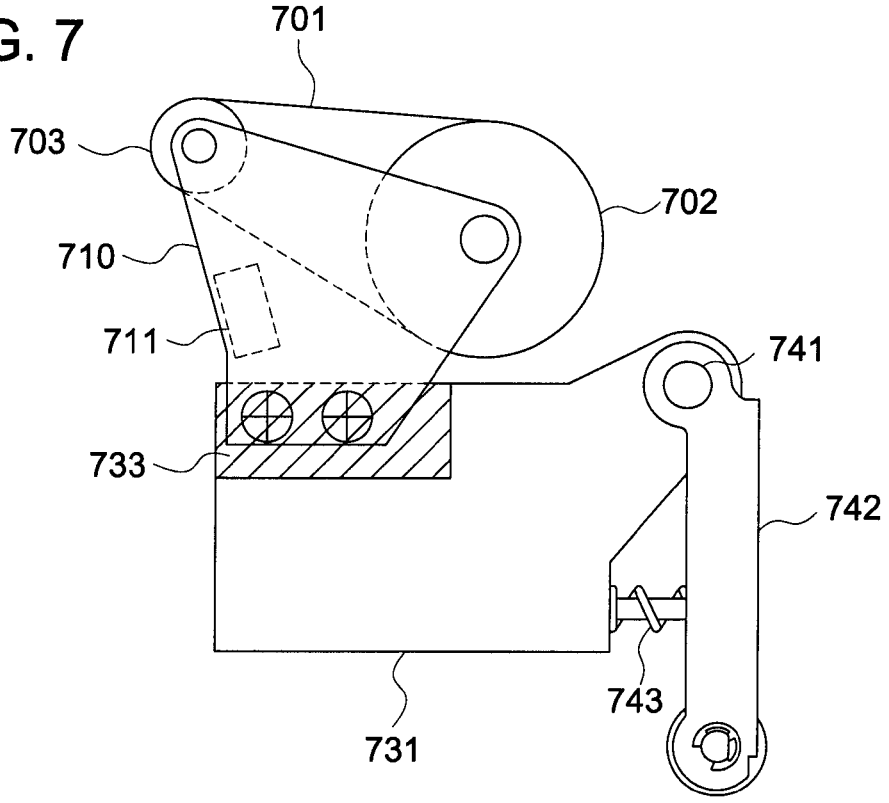
FIG. 7 is a figure showing a modified example of a swing section.
Figure 8:
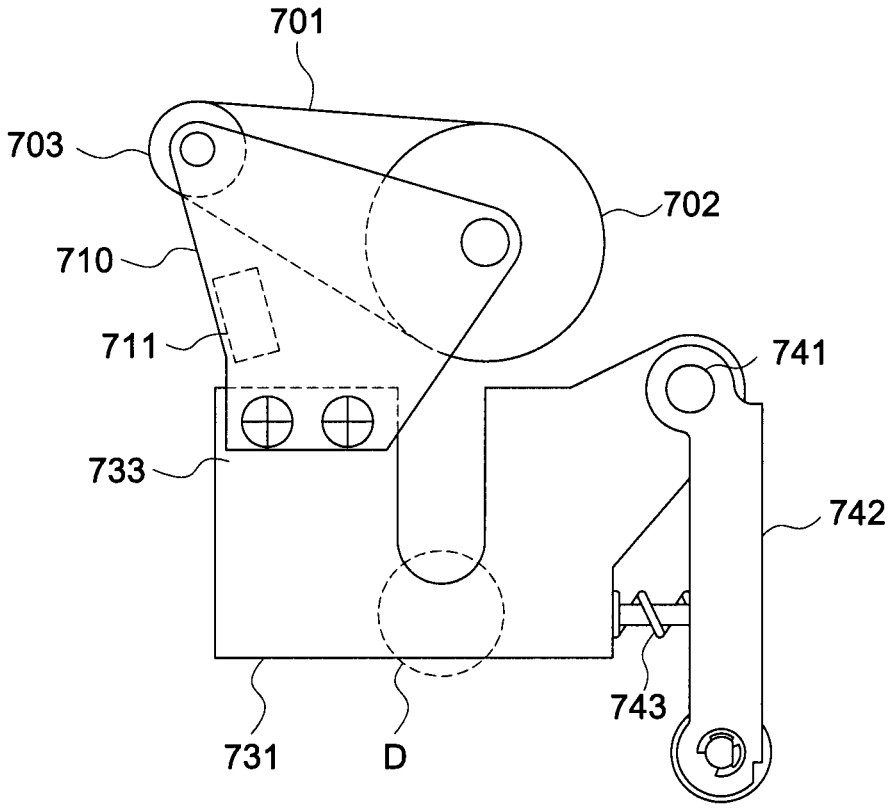
FIG. 8 is a figure showing a modified example of a swing section.

FIGS. 6 to 8 are figures showing modified examples, which are another form of the above swing section, which swingably supports the support side boards 710. The functions and actions conform to the descriptions of the transfer apparatus 70.

Modified Example 1

FIG. 6 shows a figure, in which the above swing section is constituted in a manner that the press side board 731 is divided into press side boards 731*a* and 731*b* at a nearly intermediate portion between a connection part of the press side board 731 with the support member 741 and a connection part of the press side board 731 with the support side board

710, and the press side board 731*a* and the press side board 731*b* are joined with an elastic deformation member 732 being arranged between the press side boards 731*a* and 731*b*. The support side board 710 is swingably supported by an elastic deformation of the elastic deformation member 732. As the elastic deformation member 732, rubber, spring steel, and the like are usable.

Modified Example 2

FIG. 7 shows a figure, in which the above swing section is constituted in a manner that an elastic deformation member 733 is arranged at a connection part of the press side board 731 with the support side board 710, and the press side board 731 is joined with the support side board 710 through the elastic deformation member 733. The support side board 710 is swingably supported by an elastic deformation of the elastic deformation member 733. As the elastic deformation member 733, rubber, and the like are usable.

Modified Example 3

FIG. 8 shows a figure, in which the above swing section is constituted in a manner that a portion of the above press side board, which is between a connection part of the press side board 731 with the support member 741 and a connection part of the press side board 731 with the support side board 710, has an elastically deformable structure. In the example shown in FIG. 8, a portion of the press side board 731 is cut out (the portion denoted by D in the figure) to reduce strength, by which the elastic deformation is facilitated. In order to facilitate the elastic deformation of the D portion, popular spring steel is preferably used.

In the above description, described was an example using the intermediate transfer belt 6 as the image carrier, but it is not limited to that, and, as described above, the image carrier may be a photoreceptor drum.

DESCRIPTION OF ALPHANUMERIC DESCRIPTIONS

GH: an image forming apparatus
YS: an image reading apparatus
P: a recording paper sheet
10Y, 10M, 10C, and 10K: an image forming unit
6: an intermediate transfer belt
61A: a backup roller
70: a transfer apparatus
701: a transfer belt
702: a press roller
703: a tension roller
710: a support side board
711: a connection member
721: a support member
722: a regulation member
723: a tension spring
731: a press side board
732 and 733: an elastic deformation member
741: a support member
742: an urging arm
743: a compression spring
744: a cam

The invention claimed is:

1. An image forming apparatus comprising:
an image carrier which carries toner image; and
a transfer apparatus which transfers the toner image formed on the image carrier onto a recording sheet,
wherein the transfer apparatus includes:
an endless transfer belt;
a plurality of rollers which stretches and supports the transfer belt and includes a press roller pressing the transfer belt to the image carrier;
an integrated pair of support side boards which rotatably support the plurality of rollers;
a pair of press side boards, each of which is rotatably supported in a contacting and separating direction with respect to the image carrier by a support member arranged at a frame body of the transfer apparatus;
a pair of swing sections, each of which is arranged at each press side board, and supports the press side board, swingably with respect to the image carrier, while the transfer belt and the image carrier are pressed each other;
a pair of urging members, each of which urges the press side board in a direction such that the transfer belt presses the image carrier; and
the pair of press side boards absorbs a deviation caused while the transfer belt and the image carrier are pressed to each other, by swinging the press roller and the transfer belt to the image carrier by moving the integrated pair of support side boards towards the image carrier.

2. The image forming apparatus described in claim 1, wherein each swing section is provided with a second support member which rotatably supports each support side board arranged at the press side board, and a second urging member which urges the support side board in a direction such that the transfer belt presses the image carrier.

3. The image forming apparatus described in claim 1, wherein each swing section is provided with an elastic deformation member at a connection portion between the press side board and the support side board.

4. The image forming apparatus described in claim 1, wherein the press roller opposed to the image carrier, the integrated pair of support side boards rotatably support the plurality of rollers at both ends, and the deviation represents a deviation of a parallelism between the image carrier and the press roller while the transfer belt and the image carrier are pressed each other.

5. An image forming apparatus comprising:
an image carrier which carries toner image; and
a transfer apparatus which transfers the toner image formed on the image carrier onto a recording sheet,
wherein the transfer apparatus includes:
an endless transfer belt;
a plurality of rollers which stretches and supports the transfer belt and includes a press roller pressing the transfer belt to the image carrier;
an integrated pair of support side boards which rotatably support the plurality of rollers;
a pair of press side boards, each of which is rotatably supported in a contacting and separating direction with respect to the image carrier by a support member arranged at a frame body of the transfer apparatus;
a pair of swing sections, each of which is arranged at each press side board, and supports the press side board, swingably with respect to the image carrier, while the transfer belt and the image carrier are pressed each other; and
a pair of urging members, each of which urges the press side board in a direction such that the transfer belt presses the image carrier,
wherein each swing section is provided with an elastic deformation member at an approximate center part between a connection portion between the press side board and the support member and a connection portion between the press side board and the support side board.

6. An image forming apparatus comprising:

an image carrier which carries toner image; and a transfer apparatus which transfers the toner image formed on the image carrier onto a recording sheet, wherein the transfer apparatus includes:

an endless transfer belt;

a plurality of rollers which stretches and supports the transfer belt and includes a press roller pressing the transfer belt to the image carrier;

an integrated pair of support side boards which rotatably support the plurality of rollers;

a pair of press side boards, each of which is rotatably supported in a contacting and separating direction with respect to the image carrier by a support member arranged at a frame body of the transfer apparatus;

a pair of swing sections, each of which is arranged at each press side board, and supports the press side board, swingably with respect to the image carrier, while the transfer belt and the image carrier are pressed each other; and a pair of urging members, each of which urges the press side board in a direction such that the transfer belt presses the image carrier, wherein each swing section is provided with an elastic deformable structure portion on a part of the press side board between a connection portion between the press side board and the support member and a connection portion between the press side board and the support side board.

* * * * *